US009476197B2

(12) United States Patent
Beattie

(10) Patent No.: US 9,476,197 B2
(45) Date of Patent: Oct. 25, 2016

(54) METHOD OF INSULATING A BUILDING

(71) Applicant: The Beattie Passive Build System Limited, Chedgrave, Norfolk (GB)

(72) Inventor: Ronald Peter Beattie, Chedgrave (GB)

(73) Assignee: Beattie Passive Build System Limited, Maldon, Essex (GB)

( * ) Notice: Subject to any disclaimer, the term of this patent is extended or adjusted under 35 U.S.C. 154(b) by 0 days.

(21) Appl. No.: 14/766,117

(22) PCT Filed: Feb. 7, 2014

(86) PCT No.: PCT/GB2014/050367

§ 371 (c)(1),
(2) Date: Aug. 5, 2015

(87) PCT Pub. No.: WO2014/122471

PCT Pub. Date: Aug. 14, 2014

(65) Prior Publication Data

US 2015/0368897 A1 Dec. 24, 2015

(30) Foreign Application Priority Data

Feb. 11, 2013 (GB) ..... 1302324.7

(51) Int. Cl.
*E04B 1/74* (2006.01)
*E04B 1/00* (2006.01)
*E04B 1/76* (2006.01)

(52) U.S. Cl.
CPC ..... *E04B 1/762* (2013.01); *E04B 1/76* (2013.01); *E04B 1/7604* (2013.01); *E04B 1/7608* (2013.01); *E04B 1/7654* (2013.01)

(58) Field of Classification Search
CPC ..... E04B 1/76; E04B 1/762; E04B 1/7604; E04B 1/7608; E04B 1/7654
USPC ..... 52/127.3, 127.5, 404.1, 406.1, 406.3, 52/407.1
See application file for complete search history.

(56) References Cited

U.S. PATENT DOCUMENTS 1,911,018 A 5/1933 Goeltz
2,252,578 A * 8/1941 Powell ..... E04B 1/7604 52/406.1

(Continued)

FOREIGN PATENT DOCUMENTS

DE 3435648 A1 4/1986
DE 4220071 12/1993

(Continued)

OTHER PUBLICATIONS

Search Report for corresponding Great Britain Application No. GB1302324.7, dated Aug. 27, 2013, 2 pages.

(Continued)

*Primary Examiner* — James Buckle, Jr.
(74) *Attorney, Agent, or Firm* — Knobbe, Martens, Olson & Bear, LLP

(57) ABSTRACT

A method of insulating a building that includes one or more existing external walls and an existing roof structure supported by the walls, comprises constructing a first external shell structure that covers an outer surface of at least one external wall, said shell structure being spaced from the outer surface of the wall to provide a wall void between the external wall and the shell structure. A second shell structure is constructed that extends around or through the existing roof structure and provides an enclosed roof void that extends around or through the roof structure. The roof void is interconnected with the wall void. The wall void and the roof void are filled with an insulating material to provide an insulating layer that extends substantially continuously through the roof void and the wall void.

12 Claims, 11 Drawing Sheets

(56) References Cited

U.S. PATENT DOCUMENTS

| | | | | |
|---|---|---|---|---|
| 3,331,170 | A | | 7/1967 | Lowe et al. |
| 3,559,355 | A | | 2/1971 | Day, Jr. |
| 4,030,256 | A | | 6/1977 | Ollman |
| 4,125,981 | A | | 11/1978 | MacLeod et al. |
| 4,290,246 | A | | 9/1981 | Hilsey |
| 4,399,645 | A | * | 8/1983 | Murphy ..... E04B 1/7604 52/2.11 |
| 4,509,304 | A | * | 4/1985 | Epes ..... E04B 1/78 52/127.3 |
| 4,516,363 | A | | 5/1985 | Beaulieu et al. |
| 4,522,004 | A | | 6/1985 | Evans et al. |
| 4,653,239 | A | | 3/1987 | Randa |
| 4,656,792 | A | | 4/1987 | Clark |
| 4,862,662 | A | | 9/1989 | Eberle et al. |
| 4,894,964 | A | | 1/1990 | Thrift et al. |
| 4,914,883 | A | | 4/1990 | Wencley |
| 5,205,091 | A | | 4/1993 | Brown |
| 5,287,674 | A | | 2/1994 | Sperber |
| 5,755,067 | A | | 5/1998 | Mercurio |
| 6,006,485 | A | | 12/1999 | Hobbs et al. |
| 6,052,953 | A | | 4/2000 | Jewell |
| 6,314,696 | B2 | | 11/2001 | Fust, III |
| 6,584,741 | B1 | | 7/2003 | Hatzinikolas |
| 6,854,230 | B2 | | 2/2005 | Starke |
| 7,174,681 | B2 | | 2/2007 | Wilson et al. |
| 7,185,471 | B2 | | 3/2007 | Schmerber |
| 8,793,948 | B2 | | 8/2014 | Beattie |
| 2001/0027629 | A1 | | 10/2001 | Ojala |
| 2005/0126108 | A1 | | 6/2005 | Wilson et al. |
| 2008/0016802 | A1 | | 1/2008 | Rheaume |
| 2008/0196349 | A1 | | 8/2008 | Gonzalez |

FOREIGN PATENT DOCUMENTS

| | | | |
|---|---|---|---|
| DE | 102008016882 | | 10/2009 |
| EP | 1522644 | A1 | 4/2005 |
| EP | 1600573 | A1 | 11/2005 |
| FR | 2396131 | | 1/1979 |
| GB | 825399 | | 12/1959 |
| GB | 847072 | | 9/1960 |
| GB | 2425318 | A | 10/2006 |
| GB | 2459358 | A | 10/2009 |
| GB | 2476708 | A | 7/2011 |
| JP | 2008285851 | | 11/2008 |
| WO | WO 93/14278 | A1 | 7/1993 |
| WO | WO 2009/001113 | A2 | 12/2008 |
| WO | WO 2014/122471 | A1 | 8/2014 |

OTHER PUBLICATIONS

International Search Report for corresponding International Application No. PCT/GB2014/050367, mailed Apr. 7, 2014, 3 pages.

* cited by examiner

Existing walls and roof

Vapour Cheek fixed to walls and roof

Timber blocks fixed to walls

Timber battens fixed to walls spacers

Versa panel fixed over existing roof

Roof joist fixed over roof

Versa panel fixed over roof and wall

Insulation pumped in to void around walls and roof

METHOD OF INSULATING A BUILDING

CROSS REFERENCE

This application is a U.S. National Phase of PCT International Application No. PCT/GB2014/050367, filed Feb. 7, 2014 published as WO 2014/122471 on Aug. 14, 2014, which claims priority to United Kingdom Application No. 1302324.7, filed Feb. 11, 2013. The entirety of each of the above-identified applications is hereby incorporated by reference.

BACKGROUND

The present invention relates to a method of thermally insulating a building. The invention also relates to a thermally insulated building structure. More specifically, it relates to a building having an insulating structure and to an insulating structure for a building.

Many existing buildings, especially older buildings, have a low level of thermal insulation that is not up to the level required for new buildings. As a result they can be thermally inefficient and wasteful of energy and/or uncomfortable for the occupants. There is therefore a general need to increase the level of thermal insulation in existing buildings, both for comfort and for energy conservation reasons.

Some existing buildings are built with cavity walls, which can be filled with an insulating material such as a foam. This can increase the level of insulation of the walls. In addition, the level of insulation in the roof space can be increased by laying a thick blanket of fibrous insulating material within the roof space. However, it is not possible to connect the insulating material within the cavity walls to the insulating layer provided in the roof space. As a result, there tends to be a gap in the insulating layer around the eaves where the walls meet the roof, through which heat can escape from the building. This therefore limits the amount by which the thermal efficiency of the building can be improved.

In buildings with solid walls insulating panels can be attached to the interior surfaces of the walls to reduce heat loss. However, in order to install these panels the building has to be emptied, causing considerable disruption to the occupants. A layer of insulating material can also be laid in the roof space. However, as described above, this also leaves a gap in the insulating layer where the walls meet the roof, which allows heat to escape from the building. There may also be gaps in the insulating layer where one wall meets another wall.

British Patent No. 2459358 describes a building structure in which the walls, the roof and the floor are constructed using trusses, which are interconnected to provide a void that extends continuously through the walls, the roof and the floor. This void is filled with an insulating material to provide an insulating layer that extends continuously through the walls, the floor and the roof. There are no gaps in this insulating material and heat leakage is therefore considerably reduced as compared to a conventional building structure. As a result, a building of this type is able to achieve a very high level of thermal insulation, which is much higher than can be achieved with most conventional building methods. However, the building structure described in GB 2459358 can only be used for new buildings.

SUMMARY

It is an object of the present invention to provide an insulating structure that can be applied to an existing building to increase its level of thermal insulation, and to provide a method of insulating a building.

According to one aspect of the present invention there is provided a method of insulating a building, wherein the building includes one or more existing external walls and an existing roof structure supported by the walls, the method comprising constructing a first external shell structure that covers an outer surface of at least one external wall, said shell structure being spaced from the outer surface of the wall to provide a wall void between the external wall and the shell structure, constructing a second shell structure that extends around or through the existing roof structure and that provides an enclosed roof void that extends around or through the roof structure, said roof void being interconnected with the wall void, filling the wall void and the roof void with an insulating material to provide an insulating layer that extends substantially continuously through the roof void and the wall void.

This method allows the thermal insulation of buildings to be improved very significantly, for example to a U value of less than 0.15 $W/m^2K$. This very high level of insulation is achieved owing to the fact that the insulation layer extends substantially continuously and seamlessly around the external periphery of the walls and the roof structure, and seals any gaps thus avoiding thermal bridges and preventing air leakage. The amount of heat that can escape from the building is therefore significantly reduced. The method is simple to implement, requiring only basic construction skills and avoiding the need for expensive plant and equipment. The method is suitable for buildings with both cavity walls and solid walls, and because the insulation is applied to the external surfaces of the walls there is minimal disruption for the occupants.

The method may include providing a vapour resistant membrane between the external wall of the building and the wall void, and/or below the roof void. This prevents air leakage and therefore improves the thermal insulation of the building. It also prevents moisture from travelling into the interior of the building from the exterior.

The method may include attaching spacers to at least one external wall of the building and fixing panels to the spacers to form the shell structure. This provides a very simple construction method that can be implemented easily and inexpensively.

Alternatively, or in addition, the method may include fixing truss elements to at least one external wall or surface of the building, and attaching panels to the truss elements to form the shell structure. The truss elements may be prefabricated for rapid installation. The use of truss elements has the advantage that these may have load bearing qualities, so that they can help to support reinforce the building or support an extension to the building.

The method may include fixing trusses over an existing roof structure and attaching panels to form the second shell structure. Again the trusses may be prefabricated for rapid installation. Fixing the trusses over the roof space allows the insulating layer to be installed without it affecting the loft space of the building.

Alternatively, the method may include inserting trusses through the roof structure so that they extend from one external wall to another external wall. This allows the insulating layer to be provided within the roof space without increasing the overall height of the building. In addition, the insulating layer can be installed without removing the entire roof covering: typically, only a few rows of roof tiles have to be removed in order to insert the insulating layer.

The method may include attaching the trusses to existing roof trusses.

The method may include forming a framework that extends substantially continuously through the roof structure and at least one of the wall structures.

Advantageously, the void has a width in the range 50-600 mm, preferably in the range 200-450 mm.

The method may include fixing an external finishing layer to an external surface of the first shell structure and/or the second shell structure.

According to another aspect of the present invention there is provided a building that includes one or more external walls and a roof structure supported by the walls, wherein at least one of the external walls includes a load bearing structure and a first external shell structure that covers an outer surface of the load bearing structure, said shell structure being spaced from the load bearing structure to provide a void between the load bearing structure and the shell structure, and wherein the roof structure includes a second shell structure that extends around or through the roof structure and that provides an enclosed roof void that extends around or through the roof structure, said roof void being interconnected with the wall void, and an insulating layer comprising an insulating material that extends substantially continuously through the roof void and the wall void.

The building may include a vapour resistant membrane between the interior and the wall void, and/or between the interior and the roof void.

The second shell structure may include a plurality of trusses that extend over the roof structure, and a plurality of panels fixed to the trusses to form the enclosed void.

Alternatively, the second shell structure includes a plurality of trusses that extend through the roof structure, and a plurality of panels fixed to the trusses to form the enclosed void.

BRIEF DESCRIPTION OF THE DRAWINGS

Certain embodiments of the invention will now be described by way of example with reference to the accompanying drawings, in which.

DETAILED DESCRIPTION OF CERTAIN EMBODIMENTS

Figure 1:
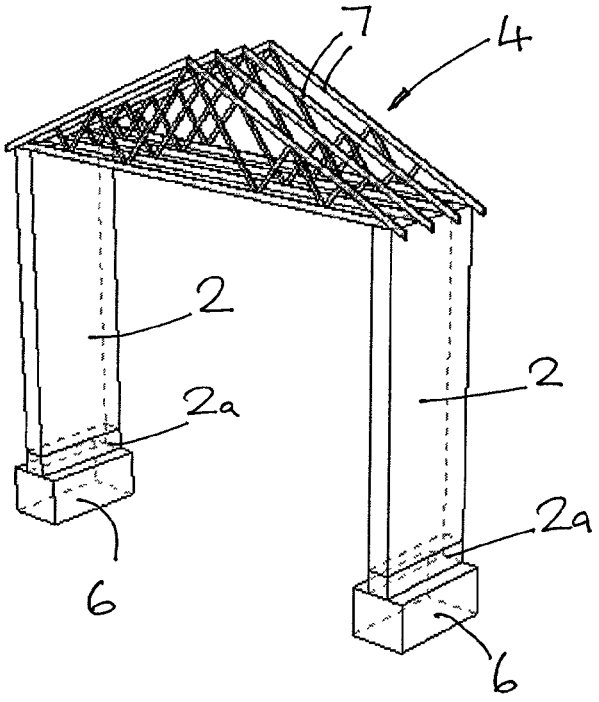
FIG. 1 is a sectional view, showing schematically part of an existing building.

FIG. 1 is a simplified diagram showing the basic structure of a conventional building having two side walls 2 supporting a roof structure 4. The end walls and the floor structures have been omitted for clarity. In this example, the side walls 2 are solid walls, which are supported on concrete foundation pads 6. The lower portions 2*a* of the walls are located below ground level. The roof structure 4 is conventional, comprising a plurality of wooden trusses 7. Roofing tiles and other roof coverings have been removed from the roof structure 4 to expose the roof trusses 7.

Figure 2:
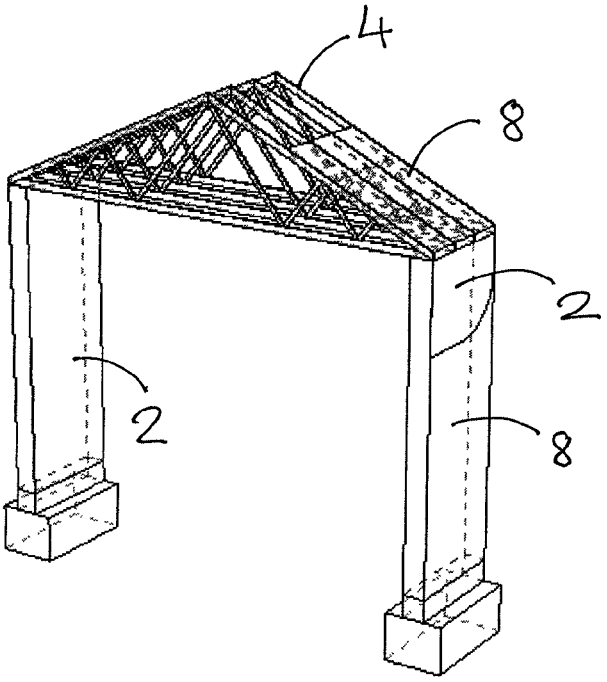
FIG. 2 is a sectional view, showing a first step of a method for insulating the building of FIG. 1.

In the first stage of the insulating method illustrated in FIG. 2, a vapour check membrane 8 is attached to the external surfaces of the walls 2 and the roof structure 4. The membrane 8 may for example comprise sheets of polythene material or any other suitable material. This membrane 8 serves to seal the building to prevent air leakage and to prevent moisture transferring into the interior of the building.

Figure 3:
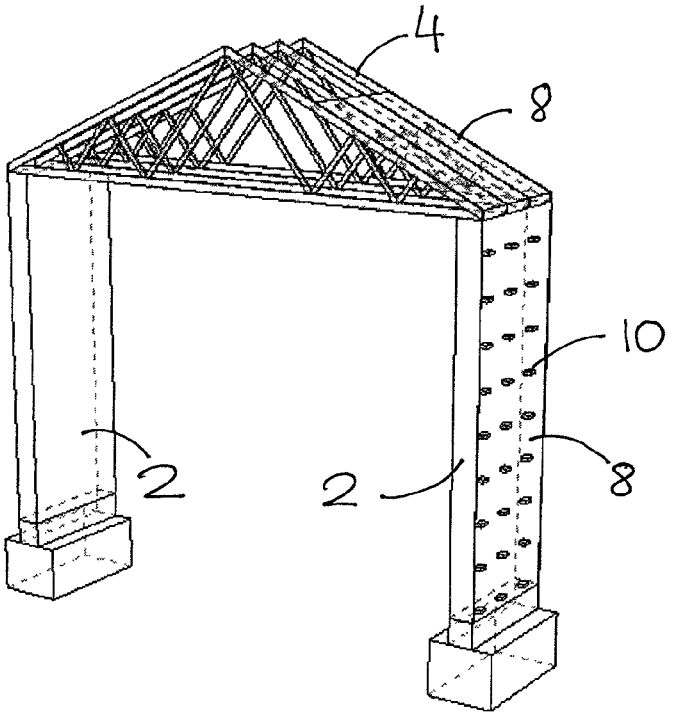
FIG. 3 shows a second step of the insulating method.
Figure 4:
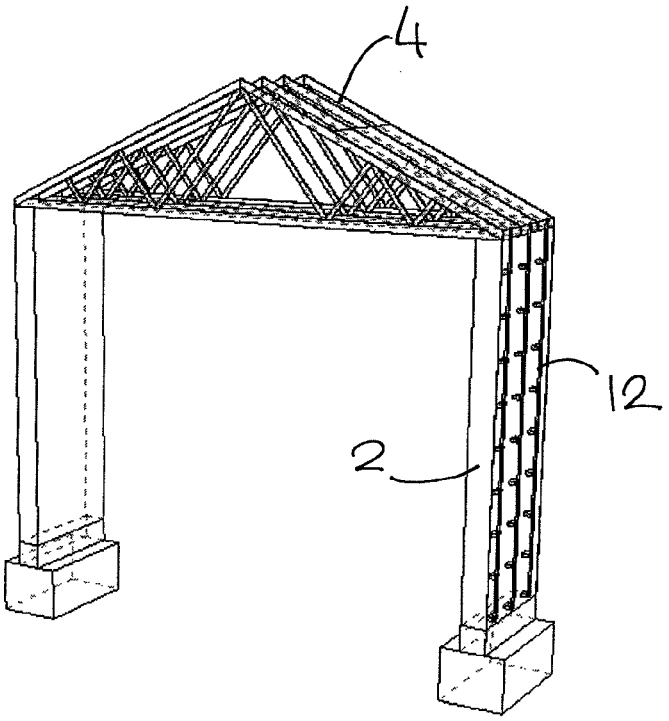
FIG. 4 shows a third step of the insulating method.

In the second step illustrated in FIG. 3 timber spacer blocks 10 are attached to the walls 2. Timber battens 12 are then fixed to the spacer blocks 10, as shown in FIG. 4. Materials other than wood may of course be used for the spacer blocks 10 and for the battens 12, although the material should preferably have a low coefficient of thermal conductivity (for example less than 1 W/mK). In this example, the battens 12 are attached vertically. They may be attached horizontally or in any other orientation. The spacer blocks 10 are designed to provide a gap between the wall 2 and the batten 12 of about 10-30 cm.

Figure 5:
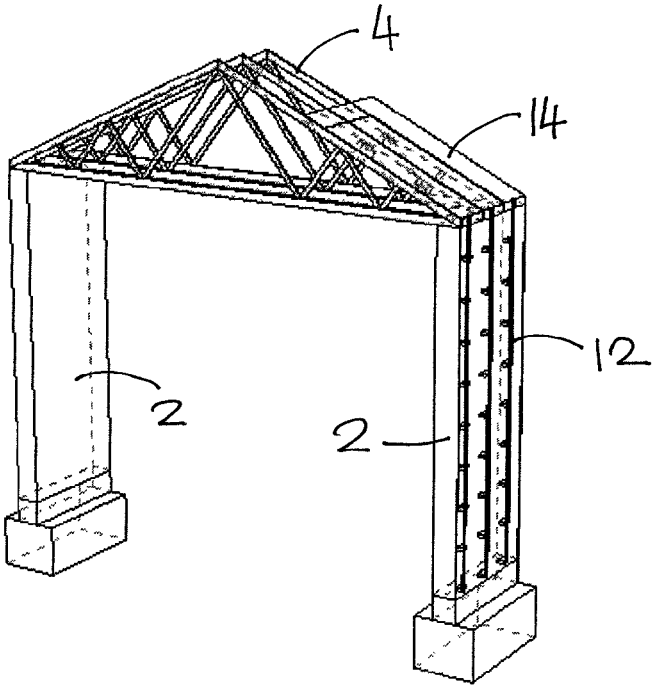
FIG. 5 shows a fourth step of the insulating method.
Figure 6:
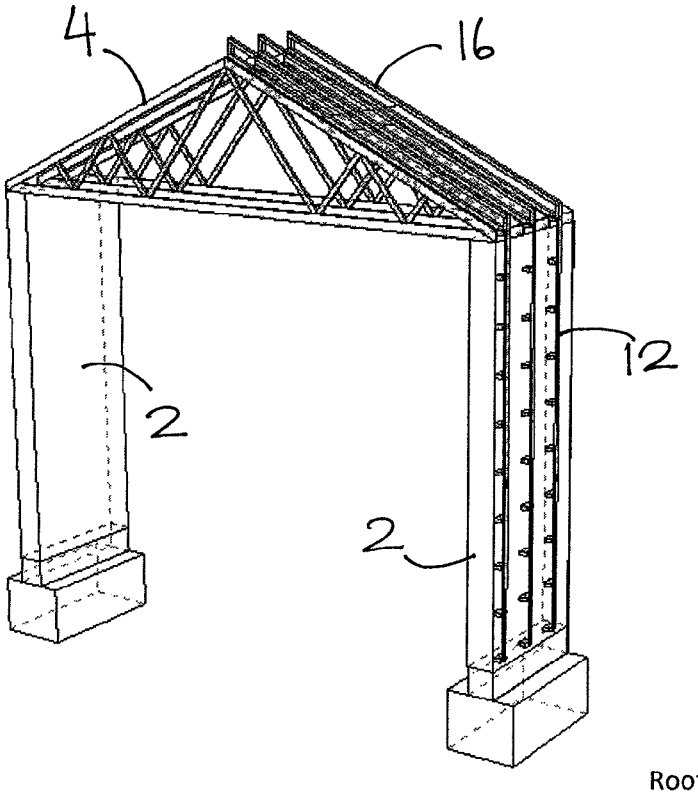
FIG. 6 shows a fifth step of the insulating method.
Figure 7:
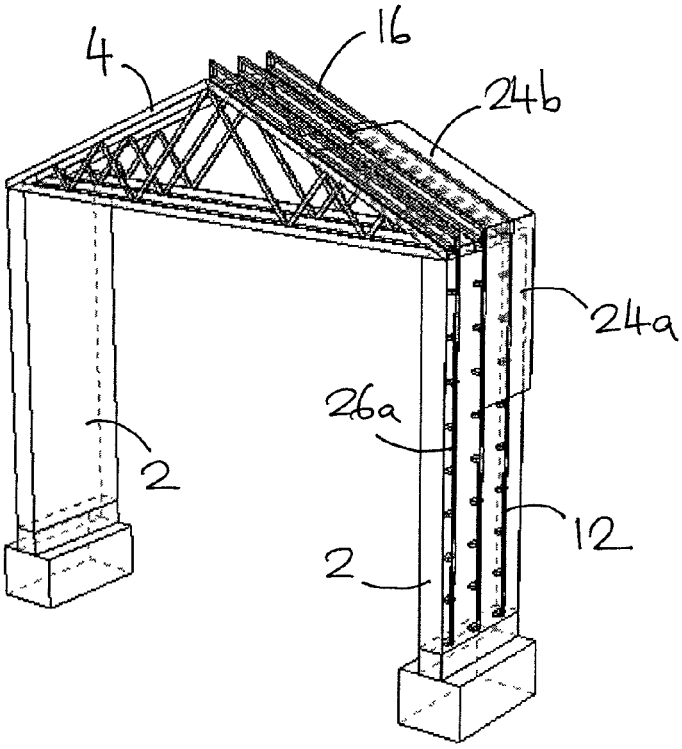
FIG. 7 shows a sixth step of the insulating method.
Figure 12:
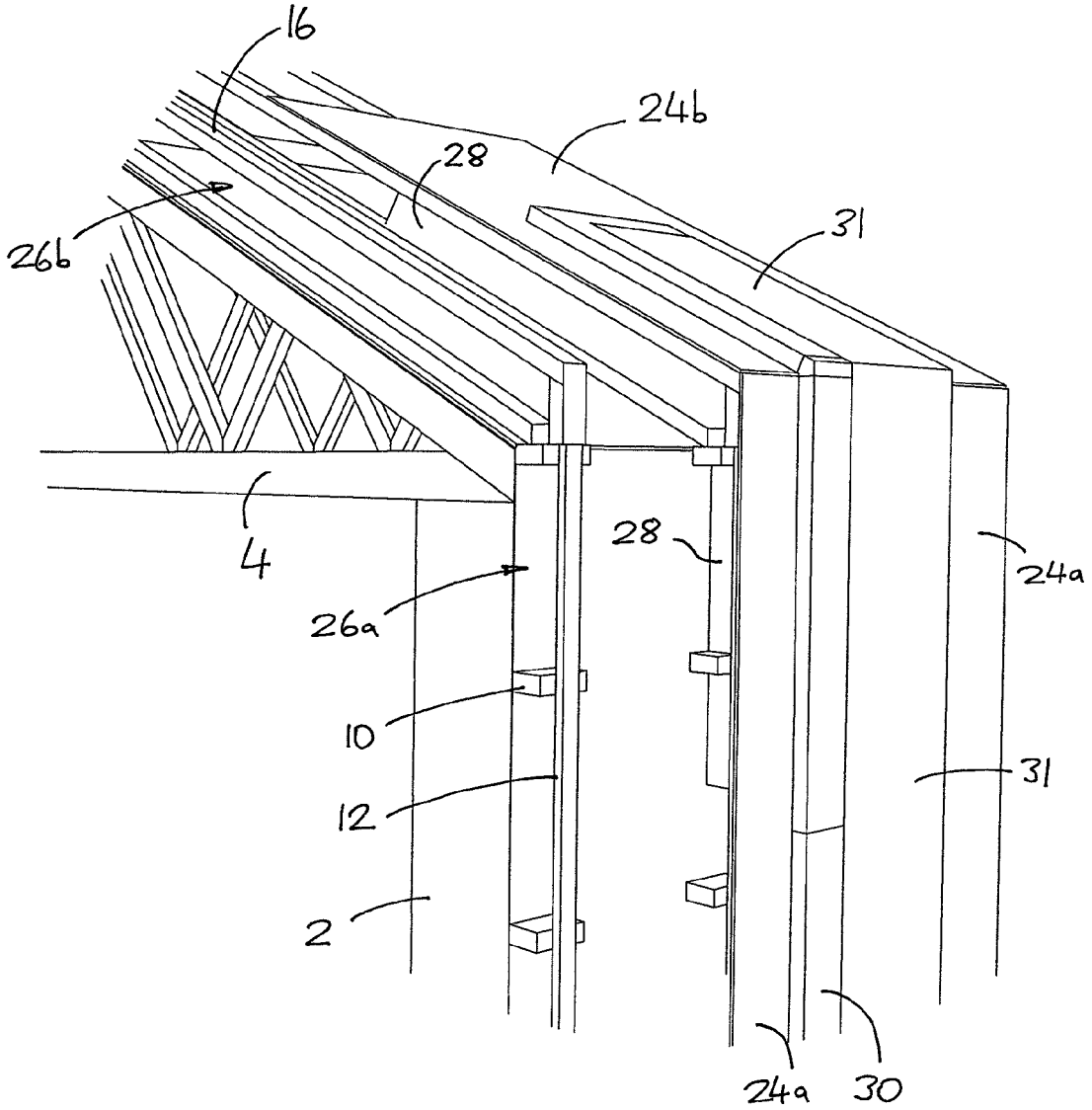
FIG. 12 is a sectional view showing at an enlarged scale an upper part of the building depicted in FIG. 9.

Structural panels 14, for example of cement bonded particle board, are then fixed over the existing roof structure 4 as shown in FIG. 5. Once these panels 14 have been attached, a set of roof trusses 16 is attached over the panels 14 as shown in FIG. 6. These roof trusses 16 may for example be similar to example T1 shown in FIG. 10, which consists of two parallel wooden joists 18*a*, 18*b* interconnected by metals ties 20. The separation of the external faces of the joists 18*a*, 18*b* is preferably approximately 50-600 mm, usually 200-450 mm. The outer ends of the trusses 16 are aligned with the battens 12 to form a continuous structure. This is illustrated more clearly in FIG. 12.

Figure 8:
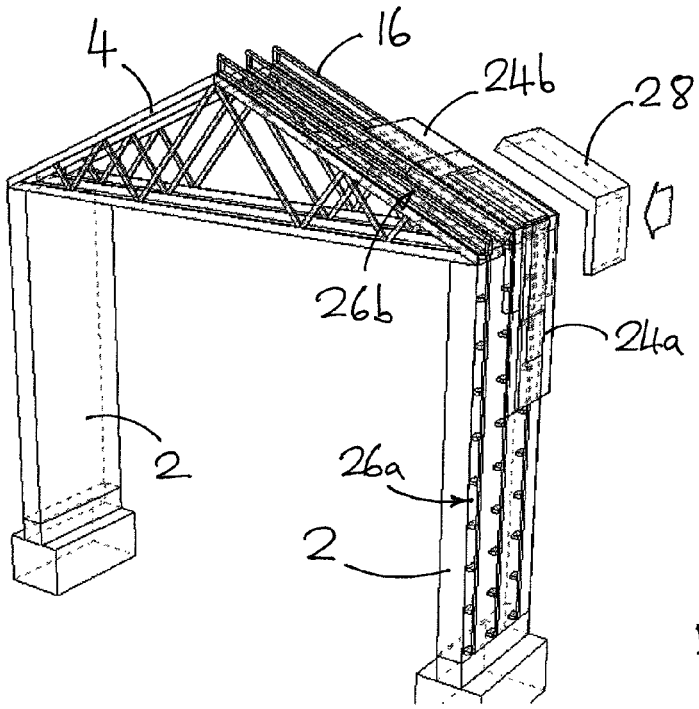
FIG. 8 shows a seventh step of the insulating method.
Figure 9:
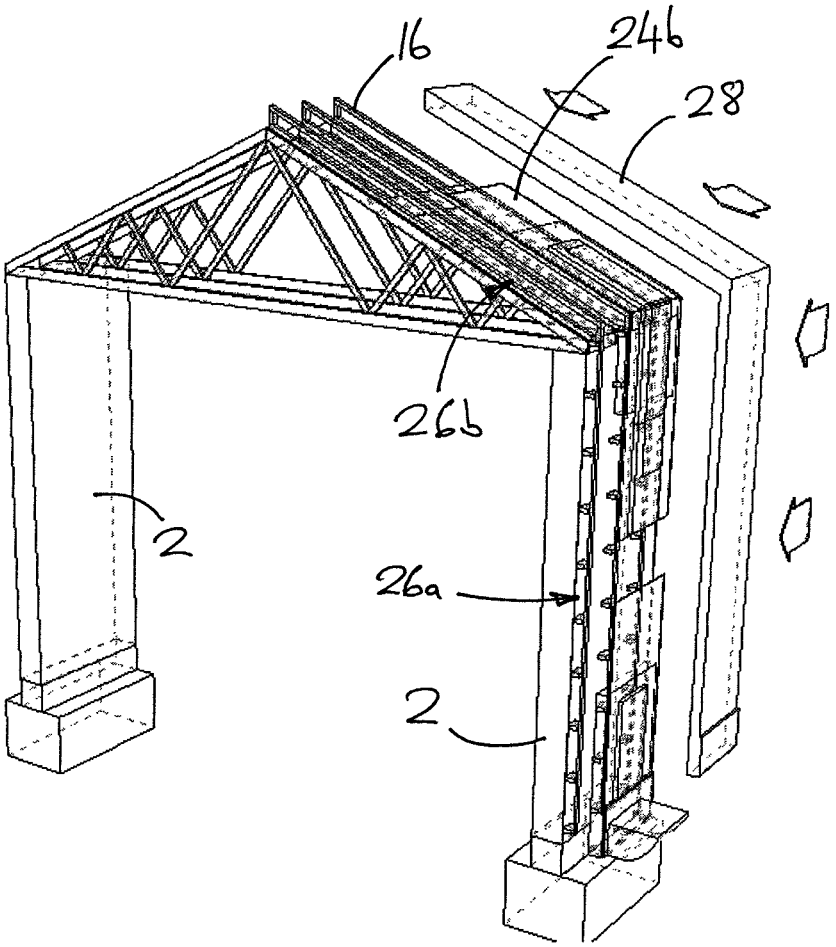
FIG. 9 shows an eighth step of the insulating method.

Structural panels 24*a*, 24*b* for example of cement bonded particle board, are then fixed over the roof trusses 16 and the battens 12 to form a new external shell that extends around the walls 2 and over the top of the roof structure 4 of the building. This provides an enclosed void 26*a*, 26*b* that extends continuously around the walls 2 and the roof structure 4. The void 26*a*, 26*b* also extends continuously through the end wall of the building (not shown). This void 26*a*, 26*b* is filled by pumping an insulating material into the void, to form a continuous insulating layer 28 that extends all around the walls and the roof, as shown in FIG. 8. Any suitable insulating material may be used including, for example, expanding foam or expanded polystyrene (EPS) pellets. The insulating material completely fills the void and forms a substantially continuous insulating layer 28 that passes through the roof trusses 16 and between the battens 12 and the wall 2.

Finally, the external walls and the roof can be covered in insulation boarding 30 and external finishing materials including, for example render or brick, cladding, roof tiling and so on. The lower part 2*a* of the wall that extends below ground level may be protected by a damp proof membrane 32.

Figure 13:
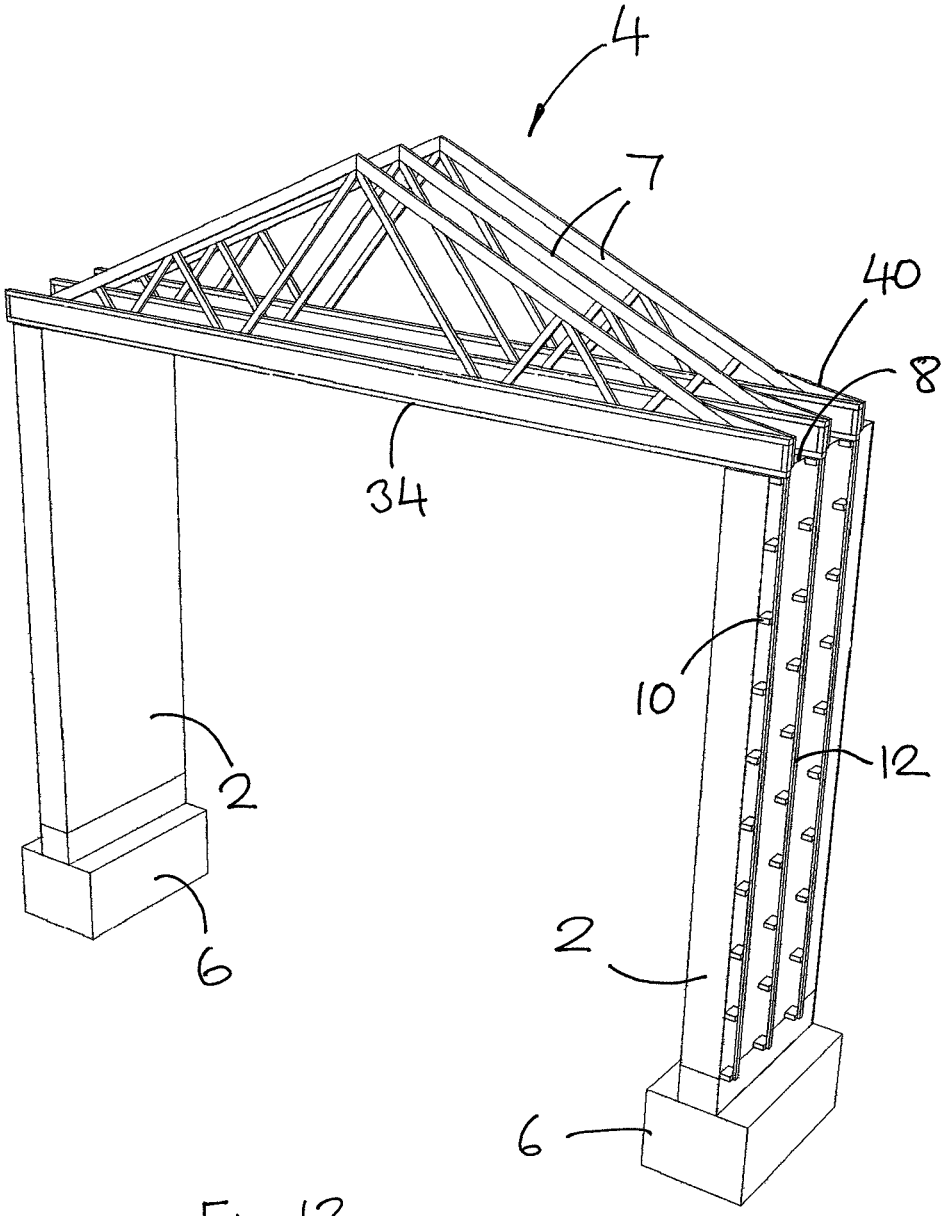
FIG. 13 is a sectional view, showing a first step of a second method for insulating the building of FIG. 1.
Figure 14:
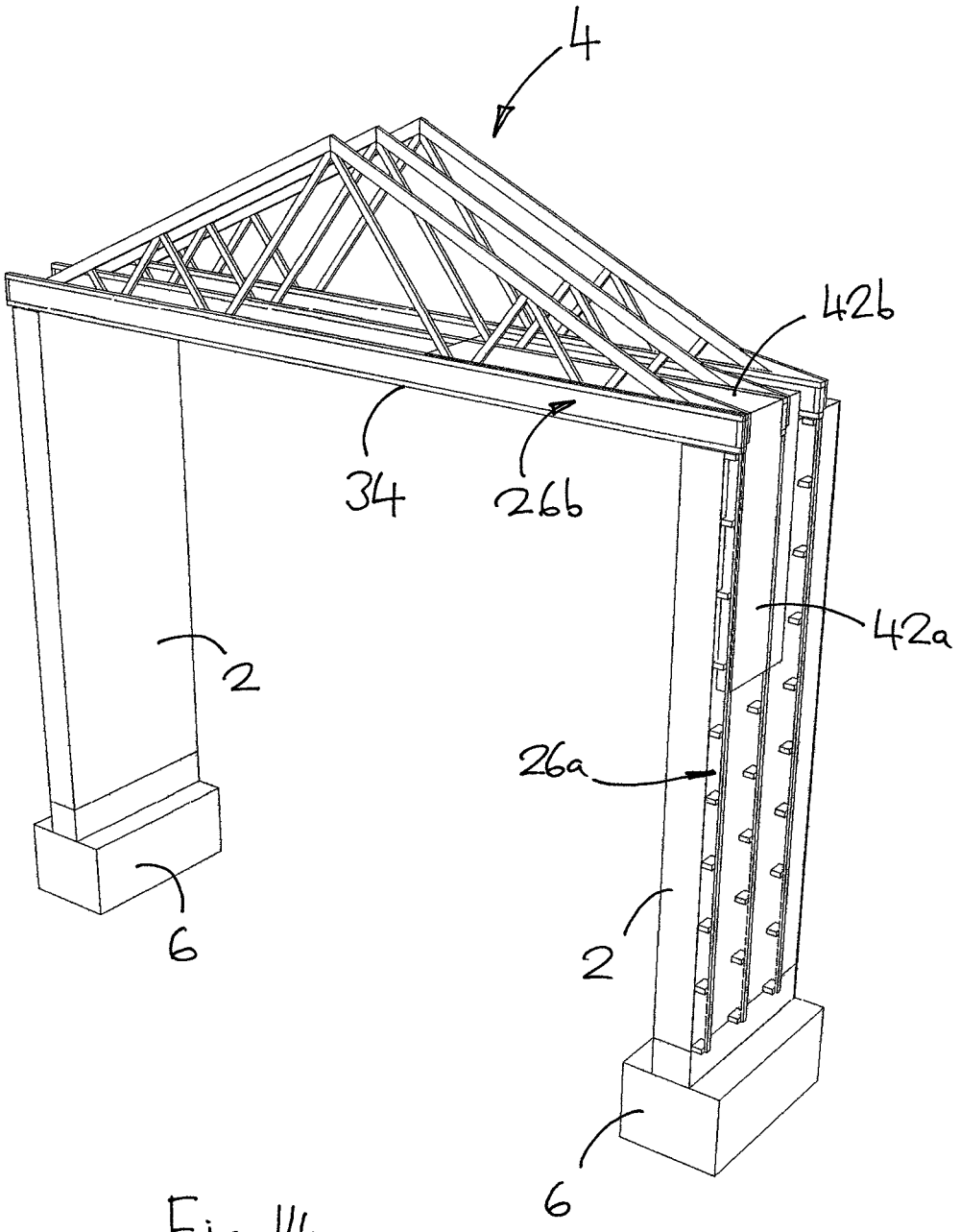
FIG. 14 shows a second step of the second insulating method.
Figure 15:
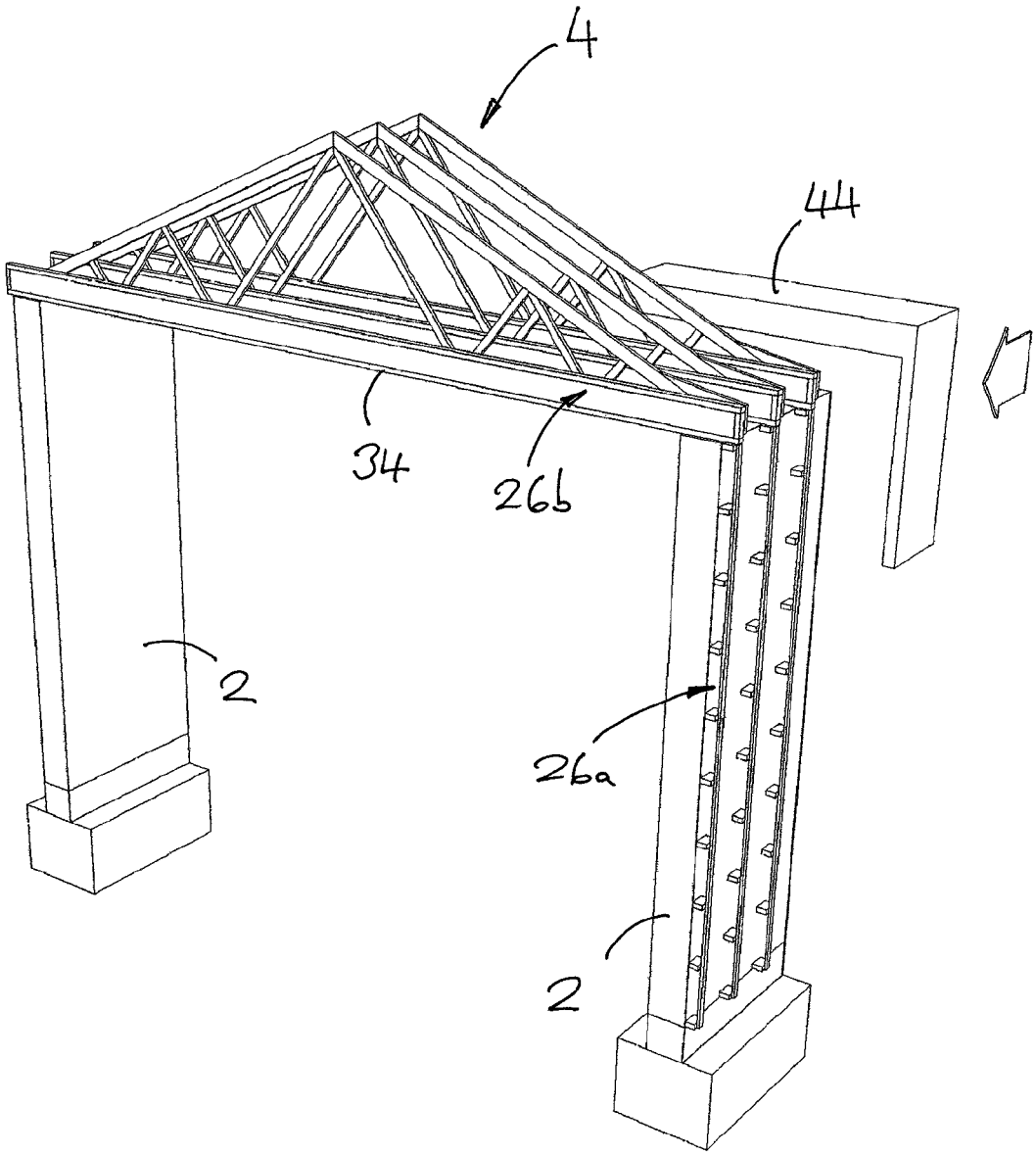
FIG. 15 shows a third step of the second insulating method.

A second insulating method according to the invention is illustrated in FIGS. 13-15. This is similar to the first method described above, except that the method allows the insulating layer to extend through the lower part of the roof structure 4 instead of passing over the top of the roof structure. The steps of the method that relate to insulating the walls 2 are exactly as described above.

Figure 10:
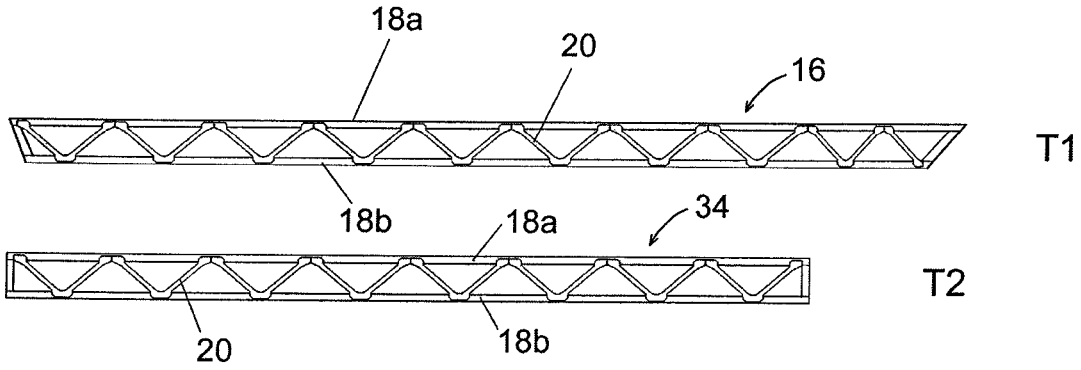
FIG. 10 illustrates two trusses used in the insulating method.
Figure 11:
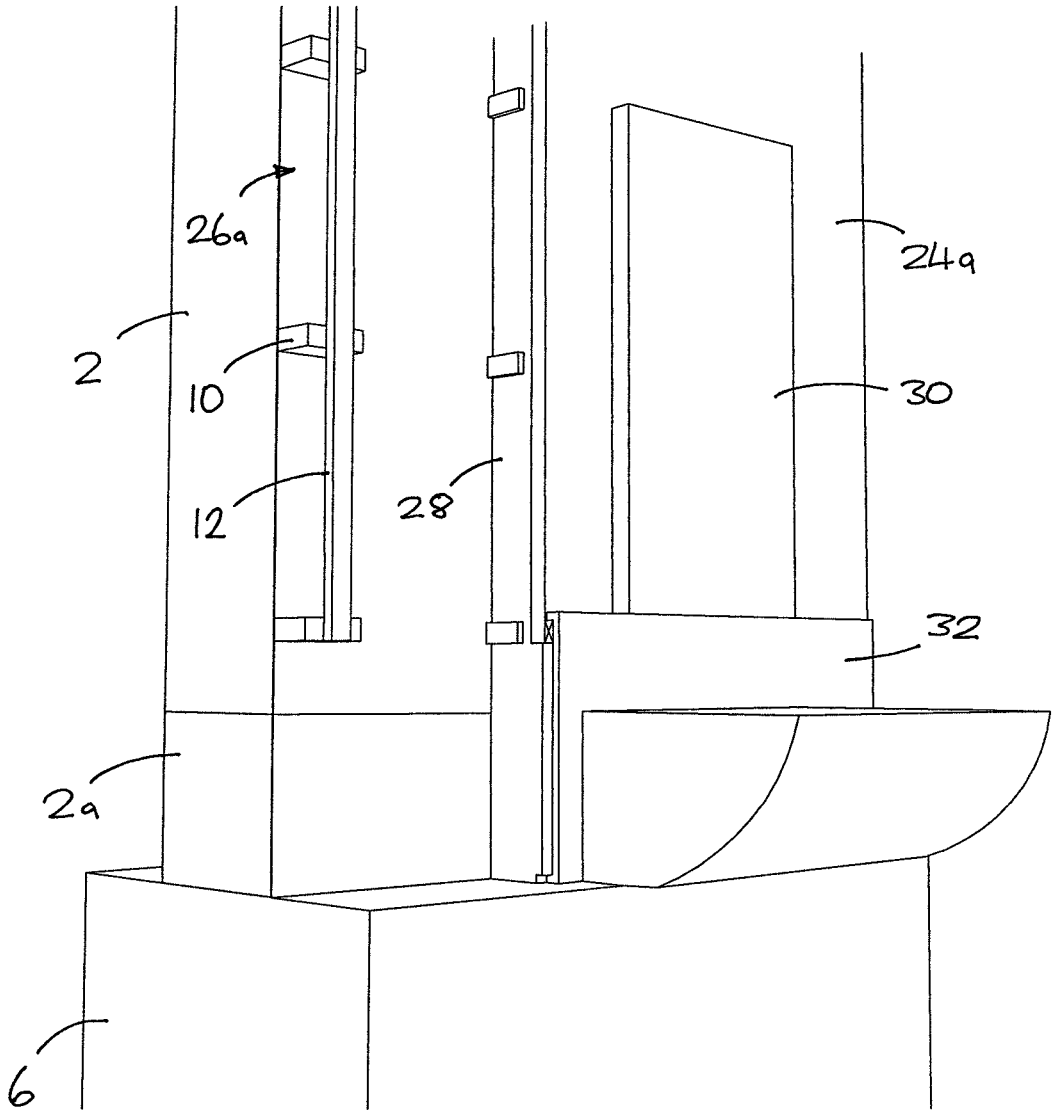
FIG. 11 is a sectional view showing at an enlarged scale a lower part of the building depicted in FIG. 9.

In this second method, after the roof covering has been removed to expose the roof structure 4, a vapour check membrane 8 is laid between the roof trusses 7 and the underlying ceiling structure, and then trusses 34 of the type T2 shown in FIG. 10 are fixed to the existing roof trusses 7 so that they extend across the lower part of the roof space. The ends of these trusses 34 are attached to the upper ends of the wall battens 12. Tapered wood fillets 40 are then attached to the upper side ends of the trusses 34 to extend the pitch of the roof at a reduced pitch angle to the ends of the trusses 34.

As shown in FIG. 14, structural boards 42*a*, 42*b*, for example of cement bonded particle board, are then fixed to the upper surfaces of the trusses 34 and the outer surfaces of the battens 12 to form a shell around the building and to create a void 26*a*, 26*b* that extends continuously around the walls and the roof space. Within the walls, this void 26*a* is located between the existing structural walls 2 of the building and the shell created by the attached structural boards 42*a*, and within the roof space it extends between the existing ceiling structure (which is not shown, but lies beneath the roof structure 4) and the structural boards 42*b*. It should be noted that the voids 26*a*, 26*b* in the walls and the roof structure are interconnected where the roof meets the walls so that the void extends continuously through both of these structures. The void also extends continuously from the side walls 2 into the front and rear walls (not shown) in a similar manner.

An insulating material is then pumped into the voids 26*a*, 26*b* to form an insulating layer 44 that extends substantially continuously through the walls and the roof structure of the building. Finally, the external walls and the roof are finished by applying insulation boarding and external finishing materials, for example of render or brick, cladding, roof tiling and so on.

A building that has been insulated using one of the insulating methods described above will generally include one or more external walls and a roof structure supported by the walls, wherein at least one of the external walls includes a load bearing structure (the pre-existing wall 2) and a first external shell structure (comprising the structural panels 24*a*) that covers an outer surface of the load bearing structure, wherein said shell structure 24 is spaced from the load bearing structure 2 by the spacer blocks 10 and the battens 12 to provide a void 26*a* between the load bearing structure 2 and the shell structure 24*a*. The roof structure 4 includes a second shell structure (comprising the structural boards 24*b*) that extends around or through the roof structure 4 and that provides an enclosed roof void 26*b* that extends around or through the roof structure 4. The roof void 26*b* is interconnected with the wall void 26*a*, and an insulating layer 28 comprising an insulating material extends substantially continuously through the roof void and the wall void.

The building may include a vapour resistant membrane 8 between the interior of the building and the wall void 26*a*, and/or between the interior of the building and the roof void 26*b*. This prevents air leakage from the building. To ensure that the air quality in the building is maintained at a high level, a forced ventilation system (not shown) may be fitted to ensure a controlled exchange of air, for example at a rate of five or six complete changes per hour. This ventilation system may include a heat recovery system, to ensure that the heat is recovered from the air exhausted from the building and used to heat the fresh air drawn into the building to an appropriate temperature.

The second shell structure 24*b* may include a plurality of trusses 14 that extend over the roof structure 4, and a plurality of panels 24*b* fixed to the trusses to form the enclosed void 26*b*. Alternatively, the second shell structure 24*b* may include a plurality of trusses 34 that extend through the roof structure 4, and a plurality of panels 42*b* fixed to the trusses to form the enclosed void 26*b*.

Various modifications of the first and second methods and structures described above are of course possible. For example, instead of attaching battens and spacer blocks to the walls of the building, trusses 34 of the type T2 shown in FIG. 10 may be attached to the walls instead. The trusses 34 then serve to support the structural boards 24*a* that form the shell structure. Although this method is more expensive than using spacer blocks and battens, the trusses 34 have a load bearing capacity and they may therefore be used reinforce the building or to support additional weight, such as the weight of an extension to the building.

Although the insulating methods and structures have been described above in relation to a building with a pitched roof, it should be understood that the methods and structures described herein may also be readily adapted for buildings with flat roofs.

The invention claimed is:

1. A method for insulating a building, wherein the building includes one or more existing external walls and an existing roof structure supported by the walls, the method comprising:

constructing a first external shell structure that covers an outer surface of at least one external wall, said shell structure being spaced from the outer surface of the wall to provide a wall void between the external wall and the first external shell structure, constructing a second shell structure that extends around or through the existing roof structure and that provides an enclosed roof void that extends around or through the roof structure, said roof void being interconnected with the wall void, and then filling the wall void and the roof void by pumping an insulating material into the wall void and the roof void to provide an insulating layer that extends substantially continuously through the roof void and the wall void.

2. A method according to claim 1, further comprising providing a vapour resistant membrane between the external wall of the building and the wall void.

3. A method according to claim 1, further comprising attaching spacers to at least one external wall of the building and fixing panels to the spacers to form the shell structure.

4. A method according to claim 1, further comprising fixing truss elements to at least one external wall of the building, and attaching panels to the truss elements to form the shell structure.

5. A method according to claim 1, further comprising fixing trusses over an existing roof structure and attaching panels to form the second shell structure.

6. A method according to claim 1, further comprising inserting trusses through the roof structure from one external wall to another external wall.

7. A method according to claim 6, further comprising attaching the trusses to existing roof trusses.

8. A method according to claim 1, further comprising forming a framework that extends substantially continuously through the roof structure and at least one of the wall structures.

9. A method according to claim 1, wherein the void has a width in the range 50-600 mm, preferably in the range 200-450 mm.

10. A method according to claim 1, further comprising fixing an external finishing layer to an external surface of the first shell structure.

11. A method according to claim 1, further comprising providing a vapour resistant membrane below the roof void of the building.

12. A method according to claim 1, further comprising fixing an external finishing layer to an external surface of the second shell structure.

* * * * *